US007777178B2

(12) United States Patent
Yeom et al.

(10) Patent No.: US 7,777,178 B2
(45) Date of Patent: Aug. 17, 2010

(54) PLASMA GENERATING APPARATUS AND METHOD USING NEUTRAL BEAM

(75) Inventors: Geun-Young Yeom, Seoul (KR); Sang-Duk Park, Suwon-si (KR); Chang-Kwon Oh, Busan (KR)

(73) Assignee: Sungyunkwan University Foundation for Corporate Collaboration, Gyeonggi-do (KR)

( * ) Notice: Subject to any disclaimer, the term of this patent is extended or adjusted under 35 U.S.C. 154(b) by 0 days.

(21) Appl. No.: 11/277,261

(22) Filed: Mar. 23, 2006

(65) Prior Publication Data

US 2007/0221833 A1 Sep. 27, 2007

(30) Foreign Application Priority Data

Mar. 22, 2006 (KR) ..... 10-2006-0026187

(51) Int. Cl.
*H05H 3/02* (2006.01)

(52) U.S. Cl. ..... 250/251; 219/121.36; 216/67; 216/68

(58) Field of Classification Search ..... 250/251, 250/492.1, 493.1; 219/121.36; 216/67, 68
See application file for complete search history.

(56) References Cited

U.S. PATENT DOCUMENTS 5,273,587 A * 12/1993 Guha et al. ..... 118/723 MW
5,449,432 A * 9/1995 Hanawa ..... 438/710
5,619,103 A * 4/1997 Tobin et al. ..... 315/111.21
5,916,455 A * 6/1999 Kumagai ..... 216/68
6,464,891 B1 * 10/2002 Druz et al. ..... 216/67
2005/0194361 A1 * 9/2005 Yeom et al. ..... 219/121.36

* cited by examiner

*Primary Examiner*—Robert Kim
*Assistant Examiner*—Michael Maskell
(74) *Attorney, Agent, or Firm*—Harness, Dickey & Pierce, L.L.C.

(57) ABSTRACT

A plasma generating apparatus and method using a neutral beam, capable of readily generating plasma at the same gas flow rate by changing the structure of an ion gun, without a separate ignition device, are provided. The apparatus includes a plasma generating part formed of a quartz cup, a radio frequency (RF) applying antenna disposed at the periphery of the plasma generating part, a cooling water supply part disposed at the periphery of the plasma generating part, and an igniter in direct communication with the plasma generating part, wherein a gas for generating plasma is supplied into the igniter, and the igniter has a higher local pressure than the plasma generating part at the same gas flow rate. The ion gun is also cheaper to manufacture since it does not require a separate power supply.

9 Claims, 4 Drawing Sheets

PLASMA GENERATING APPARATUS AND METHOD USING NEUTRAL BEAM

BACKGROUND OF THE INVENTION

1. Field of the Invention

The present invention relates to a plasma generating apparatus and method using a neutral beam, and more particularly, to a plasma generating apparatus and method capable of readily generating plasma without a separate ignition device using the same gas flow rate by varying an ion gun structure.

2. Description of the Prior Art

Plasma generating apparatuses are applied in various fields such as surface modification of metal or nonmetal material, cleaning processes of electronic components and semiconductor wafers, thus playing an important role in high-tech industry. Almost all conventional industrial plasma generating apparatuses are vacuum plasma generating apparatuses maintaining a low pressure in the high vacuum range and generating plasma. However, since it is difficult to obtain high vacuum, a large-sized apparatus being required, attempts have recently been made to replace the vacuum plasma generating apparatus with an atmospheric pressure plasma generating apparatus for generating plasma at atmospheric pressure.

The atmospheric pressure plasma generating apparatus includes a power terminal and a ground terminal spaced apart from each other, a dielectric layer installed at an inner surface of at least one of the power terminal and the ground terminal, an intermediate dielectric body installed between the power and ground terminals to prevent arc discharge therebetween and enable generation of glow plasma, a discharge gap formed under the intermediate dielectric body, a gas introduction path formed in the ground terminal, and a plurality of gas distribution orifices for making the gas introduction path in fluid communication with the discharge gap and uniformly supplying a gas injected into the gas introduction path 16 to the discharge gap.

In the atmospheric pressure plasma generating apparatus, when high-frequency power is applied to the power terminal, an electric field is formed between the power terminal and the ground terminal i.e., the discharge gap, and a gas injected into the discharge gap through the gas introduction gap is dissociated by the electric field, thereby generating plasma. The generated plasma is used to modify, clean, or sterilize a surface of a target object passing thereunder.

However, in order to initially ignite the injected gas, the atmospheric pressure plasma generating apparatus needs a very high firing voltage. Since high-frequency power having a high firing voltage is used, the apparatus may be unstable causing arcing rather than generating glow plasma. Such arcing may damage the target object.

In order to solve this problem, for example, there is a well-known atmospheric pressure plasma generating apparatus including an igniter for igniting an injection gas in an initial process, thereby generating glow plasma with low power consumption, without using a high firing voltage, and preventing damage of the target object during initial ignition.

FIG. 1 is a schematic cross-sectional view of an atmospheric pressure plasma generating apparatus including an igniter.

As shown in FIG. 1, the atmospheric pressure plasma generating apparatus includes a power terminal 52 connected to a high frequency power supply 50 and a ground terminal 54 opposite to the power terminal 52, a dielectric body 56 installed between the power terminal 52 and the ground terminal 54 to generate glow plasma therebetween, a discharge gap 58 of predetermined size between the power terminal 52 and the ground terminal 54 to discharge an injection gas, a gas introduction path 60 formed in the ground terminal 54 to supply the injection gas to the discharge gap 58, a discharge probe 62 adjacent to the discharge gap 58 and installed at one side of the gas introduction path 60 to initially ignite the injection gas, and an igniter 64 connected to the discharge probe 62 and instantly generating a high voltage to apply a discharge current to the discharge probe 62.

However, FIG. 1 illustrates the atmospheric pressure plasma generating apparatus merely including the igniter, and there is no disclosure of a plasma apparatus for layer-by-layer etching using a neutral beam.

In order to perform layer-by-layer etching using a neutral beam, it is necessary to be able to turn the plasma on/off in real time.

Nowadays, an ion gun generating neutral beam source plasma needs a pressure of about $10^{-3}$ Torr higher than a gas applied in an actual process in order to initially generate plasma, or includes an ignition device, e.g., an igniter having a separate power supply such as a microwave generator or a cold cathode.

In addition, the ion gun has a wide range of applications in various industrial fields using plasma, and may be used as a neutral beam source—next generation etching technology.

However, in conventional technology, continuous variation of a gas pressure in generating plasma may produce contamination, and there is need of a separate power supply for operating the ignition device, thereby increasing cost due to an additional neutral beam source.

In addition, in order to generate plasma in the currently used ion gun, it is necessary to either vary the pressure by varying a gas flow rate, or install an ignition device requiring a separate power supply.

SUMMARY OF THE INVENTION

An object of the present invention is to provide a plasma generating apparatus and a plasma generating method using a neutral beam capable of readily generating plasma at the same gas flow rate by changing an ion gun structure, without a separate ignition device, thereby widening application fields of the ion gun.

An aspect of the invention provides a plasma generating apparatus using a neutral beam, including a plasma generating part formed of a quartz cup, a radio frequency (RF) applying antenna disposed at the periphery of the plasma generating part, a cooling water supply part disposed at the periphery of the plasma generating part, and an igniter in direct communication with the plasma generating part, wherein a gas for generating plasma is supplied into the igniter, and the igniter has a higher local pressure than the plasma generating part at the same gas flow rate.

Another aspect of the invention provides a plasma generating method using a neutral beam, including a first step of preparing a plasma gas source for using a neutral beam, a second step of supplying the gas source to a first plasma generating part, and a third step of supplying plasma generated from the first plasma generating part to a second plasma generating part, wherein the first plasma generating part is in direct communication with the second plasma generating part, and in the third step, the plasma is supplied to the second plasma generating part through a hole formed at the first plasma generating part.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF EXEMPLARY EMBODIMENTS

Hereinafter, exemplary embodiments of the present invention will be described with reference to the accompanying drawings.

First, an etching apparatus using a neutral beam according to the present invention will be described in conjunction with FIG. 2.

Figure 1:
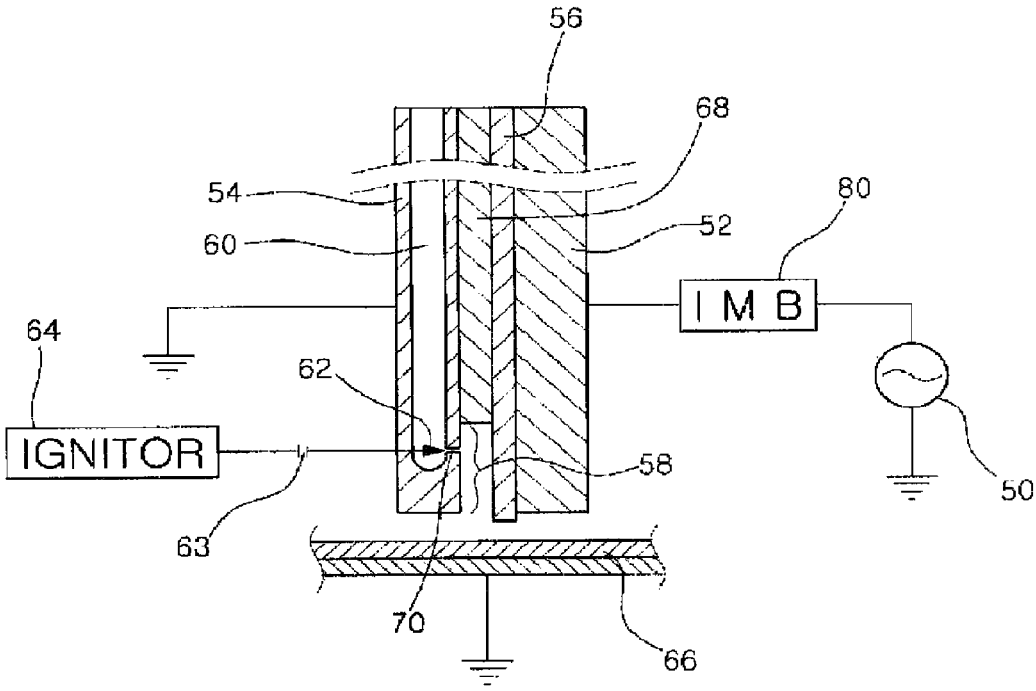
FIG. 1 is a schematic cross-sectional view of an atmospheric pressure plasma generating apparatus including a conventional igniter.
Figure 2:
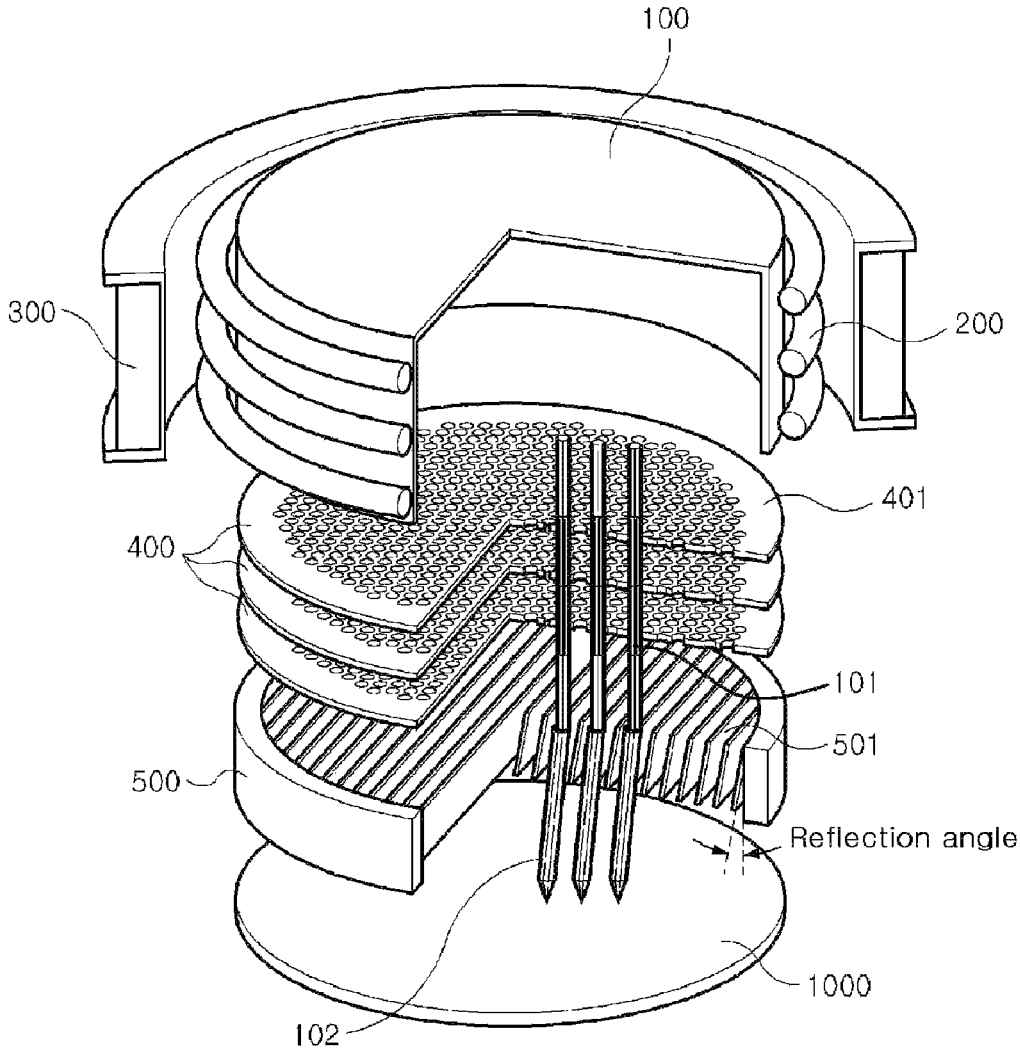
FIG. 2 is a view of an etching apparatus using a neutral beam applied to the present invention.

FIG. 2 is a view of an etching apparatus using a neutral beam applied to the present invention.

The neutral beam etching apparatus shown in FIG. 2 includes an ion source 100 for extracting and accelerating an ion beam 101 having a certain polarity, a plurality of induction coils 200 wound around the ion source 100, an electromagnet 300 for applying an magnetic field to the plurality of induction coils 200, a plurality of grids 400 disposed at an end of the ion source 100 and having a plurality of grid holes 410 through which the ion beam 101 passes, a reflective body 500 in close contact with the grids 400 and having a plurality of reflective plates 501 that correspond to the grid holes 410 and reflect the ion beam 101 passing through the grid holes 410 and convert it into a neutral beam 102, and a stage for positioning a substrate 1000 to be etched in a path of the neutral beam 102.

A retarding grid may be additionally installed between the reflective body 500 and the stage to control directionality and acceleration energy of the neutral beam 102.

Meanwhile, the reflective plates 501 may have a space equal to or larger than the diameter of the grid holes 401. In addition, the grids 400 may have a cylindrical shape with a projection formed along a periphery of their rear end, and the reflective body 500 may have a cylindrical shape with a projection formed at its front end that can be inserted into the projection of the grids 400.

In addition, the plurality of reflective plates 501 are inclined with respect to the ion beam 101 so that the ion beam 101 passing through the grid holes 401 is reflected by the reflective plates 501. The reflective plates 501 may be inclined by a certain angle with respect to a centerline of the reflective body 500, or may be parallel to the centerline of the reflective body 500. In addition, the height of the projection formed along the periphery of the reflective body 500 may be inclined by a certain angle.

In FIG. 2, the ion source 100 may be any of various ion sources but is preferably an inductively coupled plasma source. The reflective body 500 may be formed of a semiconductor substrate, a silicon dioxide substrate, or a metal substrate. The angle between the ion beam 101 and the surface of the reflective plates 501 of the reflective body 500 may be in the range of 5° to 15°.

As shown in FIG. 2, the reflective body 500 for reflecting the ion beam 101 at an appropriate angle is installed between the ion source 100 and the stage on which the substrate 1000 to be etched is mounted, thereby readily obtaining the neutral beam 102 using a simple method. In addition, since the neutral beam 102 is used as an etching source, an etching process of a nanometer semiconductor device can be readily performed without electrical or physical damage of the substrate 1000 caused by an ion beam, and therefore, a large sized substrate can also be readily etched.

Further, according to the structure shown in FIG. 2, the grids 400 formed at the rear end of the ion source 100 are in close contact with the reflective body 500 to prevent leakage of the ion beam 101, thereby remarkably reducing contamination. Therefore, flux of the neutral beam 102 can be dramatically increased, and space occupied by the reflective body 500 can be reduced, thereby yielding a compact and inexpensive etching apparatus.

The constitution of a plasma generating apparatus of the present invention will now be described in conjunction with FIG. 3.

In addition, like reference numerals designate like elements throughout the specification.

Figure 3:
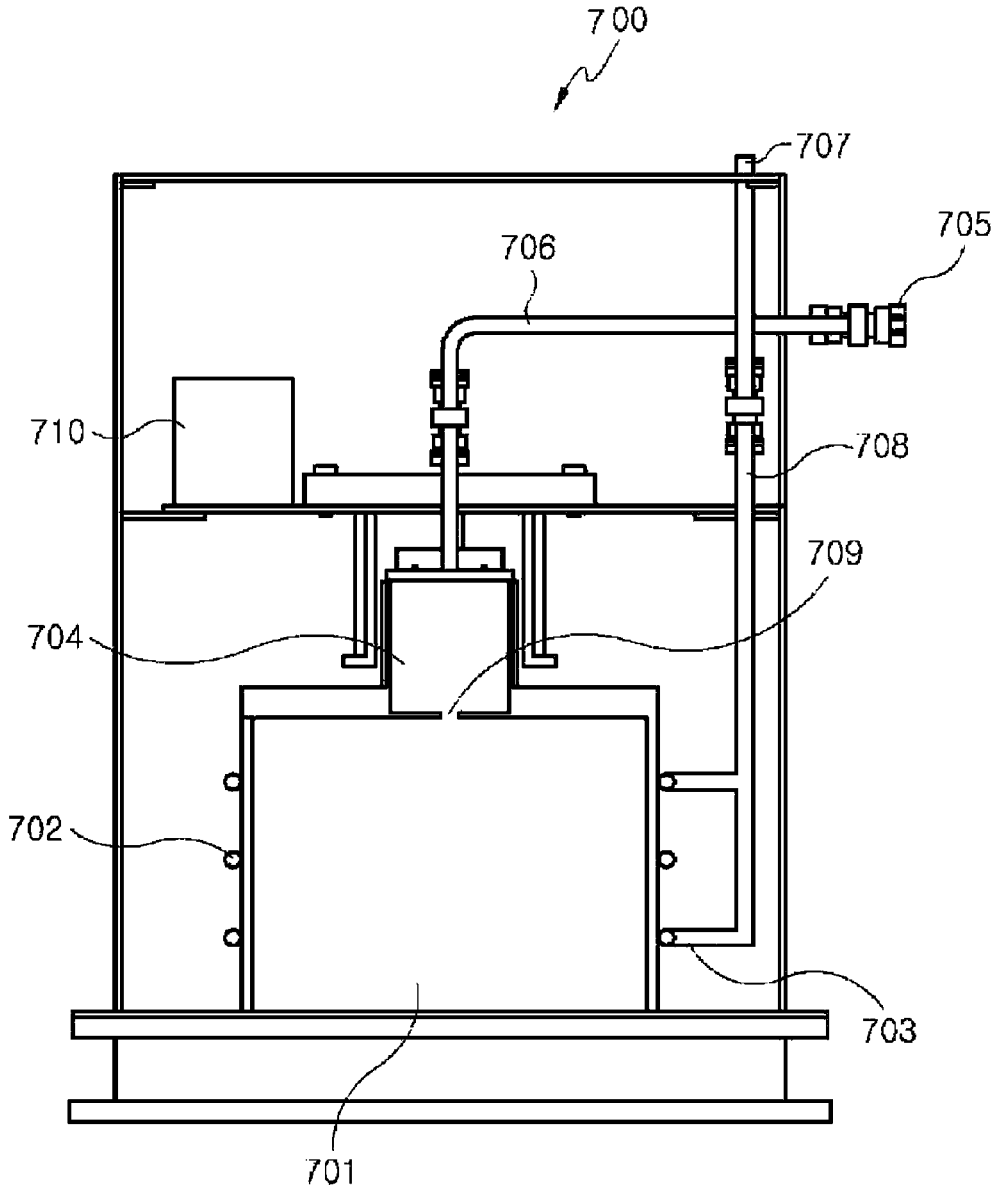
FIG. 3 is a view of a plasma generating apparatus using a neutral beam according to the present invention.

FIG. 3 is a view of a plasma generating apparatus 700 using a neutral beam according to the present invention.

In FIG. 3, a plasma generating part 701 is formed of a quartz cup and generates plasma, an RF applying antenna 702 is disposed at a periphery of the plasma generating part 701 and applies a radio frequency so that plasma can be smoothly generated from the plasma generating part 701, and a cooling pipe 703 is disposed at the periphery of the plasma generating part 701 to cool the plasma generating part 701.

In addition, an igniter 704 in direct communication with the plasma generating part 701 has a volume smaller than a main quartz cup of the plasma generating part 701 and a local pressure higher than the plasma generating part 701 at the same gas flow rate, thereby facilitating generation of plasma from the plasma generating part 701.

That is, it is possible to locally increase gas pressure by installing the igniter 704 formed of a quartz cup in the ion gun formed of quartz, without changing the gas flow rate and without a separate power supply. It was confirmed that the ion gun according to the present invention readily generates plasma even at a pressure of $10^{-5}$ Torr.

The igniter 704 according to the present invention is formed of a small volume of quartz cup connected to the ion gun, i.e., the plasma generating part 701. Since a hole 709 having a diameter of 0.5 mm-2 mm is disposed between the main cup of the ion gun and the small cup of the igniter 704, the igniter 704 can have a locally high pressure at the same gas flow rate.

When the hole 709 has a diameter of 0.5 mm or less, gas supplied from the igniter 704 to the plasma generating part 701 cannot flow smoothly, and when the hole 709 has a diameter of 2 mm or more, the effect of installation of the igniter 704 is remarkably reduced. The hole 709 preferably has a diameter of 1 mm.

Due to the local gas pressure difference, the plasma is first generated from the small quartz cup, the igniter 704. Ions and electrons generated in the plasma are readily accelerated by external power to facilitate generation of plasma from the main cup, the plasma generating part 701.

That is, as shown in FIG. 3, the small volume of quartz cup, i.e., the igniter 704 is disposed on the main cup plasma generating part 701. The plasma generated from the igniter 704 passes through the hole 709 formed at a lower part of the igniter 704 to be supplied into the main cup plasma generating part 701.

In FIG. 3, reference numeral 705 designates an injection port of a plasma gas source for generating a neutral beam, and reference numeral 706 designates a gas supply pipe for supplying gas injected through the gas injection port 705 into the small volume of quartz cup, i.e., the igniter 704.

Reference numeral 707 designates a cooling water injection port for supplying cooling water into a cooling pipe 703 to cool the plasma generating part 701, and reference numeral 708 designates a cooling water supply pipe for supplying the cooling water supplied through the cooling water injection port 707 into the cooling pipe 703. In addition, a regulation valve may be installed in the cooling pipe 703 or the gas supply pipe 706 to adjust the supply of cooling water or gas.

In FIG. 3, reference numeral 710 designates an electromagnetic interference (EMI) filter for blocking electromagnetic waves generated in the plasma generating apparatus 700 according to the present invention.

Generation of plasma in the plasma generating apparatus 700 shown in FIG. 3 will be described below with reference to FIG. 4.

Figure 4:
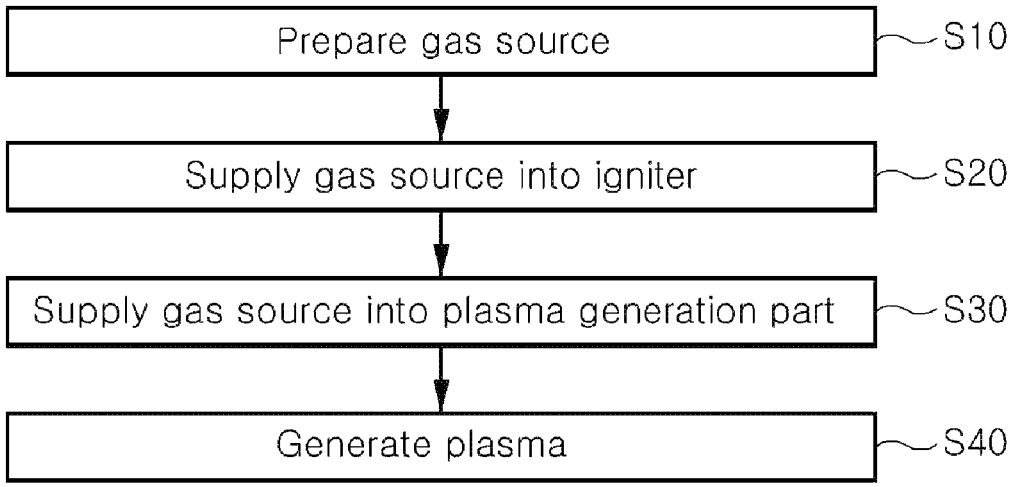
FIG. 4 is a flowchart for explaining a process of generating plasma in the plasma generating apparatus shown in FIG. 3.

FIG. 4 is a flowchart for explaining a process of generating plasma in the plasma generating apparatus 700 shown in FIG. 3.

First, when gas is injected through the plasma gas source injection port 705 for generating a neutral beam (S10), the gas is supplied into the small volume of quartz cup, i.e., the igniter 704 via the gas supply pipe 706 (S20).

Next, the igniter 704 generates first plasma using the plasma gas source, and the plasma gas generated by the igniter 704 is supplied into the main cup plasma generating part 701 via the hole 709 formed in the lower part of the igniter 704 (S30).

Plasma is generated from the gas supplied into the main cup plasma generating part 701, by the RF applying antenna 702, similar to in a conventional plasma treatment apparatus (S40).

Then, processes of supplying cooling water, blocking electromagnetic waves, and so on are performed like in the conventional plasma treatment apparatus. These processes will not be described herein.

Therefore, a plasma generating apparatus using an ion gun according to the present invention can readily generate plasma, even at a pressure of $10^{-5}$ Torr.

As can be seen from the foregoing, the plasma generating apparatus and method using a neutral beam according to the present invention can reduce instability of process conditions, since there is no need to vary a gas flow rate or install an ignition device having a separate power supply, when the structure of the conventional ion gun is changed. In addition, since the igniter is formed of the same material as the ion gun, it is possible to prevent contamination during plasma generation. Further, since a separate power supply is not necessary, manufacturing cost of the ion gun can be reduced.

Furthermore, using the ion gun widely employed in a semiconductor and surface treatment process requiring plasma, it is possible to apply the apparatus and method of the present invention to processes requiring accurate plasma generation such as layer-by-layer etching using a neutral beam.

While this invention has been described with reference to exemplary embodiments thereof, it will be clear to those of ordinary skill in the art to which the invention pertains that various modifications may be made to the described embodiments without departing from the spirit and scope of the invention as defined in the appended claims and their equivalents.

What is claimed is:

1. A plasma generating apparatus using a neutral beam applied to etching atomic layers, comprising:

a plasma generating part formed of a quartz cup and generating plasma;

a radio frequency (RF) applying antenna disposed at the periphery of the plasma generating part;

a cooling water supply part disposed at the periphery of the plasma generating part; and an igniter in direct communication with the plasma generating part;

wherein the igniter has a higher local pressure than a local pressure of the plasma generating part at the same gas flow rate, wherein the plasma generating apparatus is configured to support a substrate below the plasma generating part allowing generated plasma to etch the substrate, wherein the igniter does not have a separate power supply, the igniter being configured to generate plasma in response to a RF signal generated from the RF applying antenna, the igniter being disposed on the plasma generating part, wherein a gas for generating plasma is supplied into the igniter in a direction substantially perpendicular to a surface of the substrate, the plasma generated by the igniter being supplied to the plasma generating part in the direction substantially perpendicular to the surface of the substrate from an upper region of the plasma generating part to a lower region of the plasma generating part, wherein the etching process is an etching of atomic layers.

2. The plasma generating apparatus according to claim 1, wherein the igniter is formed of quartz cup, and the igniter has a smaller volume than a volume of the plasma generating part.

3. The plasma generating apparatus according to claim 2, wherein the igniter has a hole in communication with the plasma generating part.

4. The plasma generating apparatus according to claim 3, wherein the hole has a diameter of about 0.5 mm-2 mm.

5. A plasma generating method using a neutral beam applied to etching atomic layers, comprising:

preparing a plasma gas source for using a neutral beam;

supplying the gas source to a first plasma generating part; and supplying plasma generated from the first plasma generating part to a second plasma generating part, wherein a substrate to be etched is disposed below the second plasma generating part, wherein the first plasma generating part is in direct communication with the second plasma generating part, and the plasma is supplied from the first plasma generating part to the second plasma generating part through a hole formed at the first plasma generating part, wherein the first plasma generating part does not have a separate power supply and generates plasma in response to a radio frequency (RF) signal generated from a radio frequency (RF) applying antenna, the first plasma generating part being disposed on the second plasma generating part, the gas source being supplied into the first plasma generating part in a direction substantially perpendicular to a surface of the substrate so that the gas is supplied, in a direction substantially perpendicular to the surface of the substrate, from an upper region of the second plasma generating part to a lower region of the second plasma generating part, wherein electromagnetic waves are blocked by an electromagnetic interference (EMI) filter, wherein the first plasma generating part is disposed on the second plasma generating part, wherein the plasma generated from the second plasma generating part performs an etching process on the substrate, wherein the etching process is an etching of atomic layers.

6. The plasma generating method according to claim 5, wherein the first plasma generating part includes an igniter formed of a quartz cup, and the igniter has a smaller volume than a volume of the second plasma generating part.

7. The plasma generating method according to claim 6, wherein the hole has a diameter of about 0.5 mm-2 mm.

8. The plasma generating method according to claim 7, wherein the igniter has a higher local pressure than a local pressure of the second plasma generating part at the same gas flow rate.

9. The plasma generating apparatus according to claim 4, further comprising:

an electromagnetic interference (EMI) filter for blocking electromagnetic waves generated in the plasma generating apparatus.

* * * * *